US008888075B2

(12) United States Patent
Venaas

(10) Patent No.: US 8,888,075 B2
(45) Date of Patent: Nov. 18, 2014

(54) DEVICE FOR ADDING FLUID TO A LIQUID

(75) Inventor: Karl Venaas, Haslum (NO)

(73) Assignee: ALU Innovation AS, Trondheim (NO)

( * ) Notice: Subject to any disclaimer, the term of this patent is extended or adjusted under 35 U.S.C. 154(b) by 997 days.

(21) Appl. No.: 12/920,995

(22) PCT Filed: Mar. 11, 2009

(86) PCT No.: PCT/NO2009/000089
§ 371 (c)(1),
(2), (4) Date: Sep. 3, 2010

(87) PCT Pub. No.: WO2009/113871
PCT Pub. Date: Sep. 17, 2009

(65) Prior Publication Data

US 2011/0007600 A1 Jan. 13, 2011

(30) Foreign Application Priority Data

Mar. 12, 2008 (NO) ..... 20081300

(51) Int. Cl.

| | |
|---|---|
| ***B01F 7/28*** | (2006.01) |
| ***F27D 27/00*** | (2010.01) |
| ***C21C 1/06*** | (2006.01) |
| ***F27D 3/16*** | (2006.01) |
| ***C22B 9/05*** | (2006.01) |
| ***C22B 21/06*** | (2006.01) |
| *B01F 3/04* | (2006.01) |
| *C21C 7/072* | (2006.01) |
| *C21C 7/00* | (2006.01) |

(52) U.S. Cl.

CPC ..... *B01F 3/04539* (2013.01); *F27D 27/00* (2013.01); *B01F 2003/04695* (2013.01); *C21C 1/06* (2013.01); *F27D 3/16* (2013.01); *B01F 2003/04546* (2013.01); *C22B 9/05* (2013.01); *C21C 7/072* (2013.01); *C22B 21/064* (2013.01); *C21C 7/0037* (2013.01)

USPC ..... 261/87; 366/102

(58) Field of Classification Search

CPC ..... B01F 7/285
USPC ..... 261/85–87; 366/102
See application file for complete search history.

(56) References Cited

U.S. PATENT DOCUMENTS

| | | | | |
|---|---|---|---|---|
| 3,900,164 | A * | 8/1975 | Friestad | 239/222 |
| 3,972,709 | A | 8/1976 | Chia | |
| 4,297,214 | A * | 10/1981 | Guarnaschelli | 210/219 |
| 5,413,315 | A * | 5/1995 | Venas et al. | 266/222 |
| 6,168,307 | B1 | 1/2001 | Venaas | |

* cited by examiner

*Primary Examiner* — David Sorkin
(74) *Attorney, Agent, or Firm* — Ladas & Parry LLP

(57) ABSTRACT

Device for adding a fluid to a liquid, for example of gas and/or particles to liquid metal. A rotor is rotated immersed in the liquid, comprising a hollow rotational body 10 with a first inner annular wall 16 with at least one radial opening 18 from a central, cylindrical chamber 19 and with an opening directed downwards. The rotational body is carried by a generally vertical shaft 12 which is connected to a powering unit and which may be arranged to lift the rotational body out of, respectively lower it into the liquid. Outside the central annular wall 16 of the rotational body 10 a further annular wall 14 which forms an annular chamber 17 is arranged, which communicates with the central chamber through the one or more radial openings 18. Advantages are achieved by that the one or more of the radial openings 18 are arranged in the lower part of the inner annular wall 16 of the rotational body, in a area which projects down under the surrounding additional annular wall 14.

5 Claims, 1 Drawing Sheet

DEVICE FOR ADDING FLUID TO A LIQUID

BACKGROUND OF THE INVENTION

The invention relates to a device for adding fluid to a liquid. The term "fluid" should here be understood as a gas, a liquid or a mix of these, possibly with the addition of particles. Some particle masses may also be treated and transported as a fluid.

For some purposes there is a need for treatment of liquids, such as melted metals, by addition of a fluid. Particularly actual fluids in connection with metal melting are a gas and/or a particular material. For this purpose it is known to use a device with a rotor which is submerged in the liquid and where a fluid, that is gas and/or particles, is added through the inner part of the rotor.

Such a rotor may comprise a hollow rotational body with openings in the bottom and the side, which is mounted and driven via a shaft by a driving unit and that is arranged to be lifted out of and lowered into the liquid. When a gas reacts with a liquid, the speed of the reaction will be a function of the surface of the gas bubbles that is in inverse ratio with the diameter of the gas bubbles. That is, gas bubbles with a small diameter are desired.

Generally there is a desire for rotors in treatment of liquid, in particular treatment of melted metals, that the addition of gas or a particular material is effective. At the other side, there is also a desire not to create too much stirring or turbulence which causes a turbulent surface and whirls in the liquid and thereby causes an increased addition of undesirable gas from the environment (atmosphere).

It is previously known equipment for treatment and addition of a particular material in a liquid as mentioned above. Thus it is known from the inventors Norwegian patent 155447 a rotor for treatment and addition of material in a liquid where the rotor is constituted by a symmetric rotational hollow body, and where the material is added to the liquid via a bore in the rotor shaft and further out through a hole in the side of the hollow body together with the liquid, which due to the centripetal force is sucked in through an opening in the bottom and circulate through the body.

From the inventors own patent Norwegian patent application 19983142 it appears a solution by rotors for treatment of liquid where the efficiency when intermixing gas or particles into a liquid is close to doubled, but where the stirring is maintained unchanged related to the design shown in NO 155447. Further it is reached a solution by rotors where the use of gas/particles is less than the half.

From the Norwegian patent 307289 it is known a device for addition of a fluid to a liquid, for example of gas and/or particles to a liquid metal, with a rotor which is driven immersed in the liquid and which comprises a hollow rotational body with a first inner annular wall and at least one radial opening from a centrally, cylinder shaped hollow room with an opening facing downwards, as the rotational body is carried by a generally vertical shaft which is connected to a driving unit and which may be arranged to lift the rotational body out, respectively lower it into the liquid, where it outside the central annular wall of the rotational body is arranged an additional annular wall which forms an annular chamber, which communicates with the central chamber through the one or more radial openings.

A disadvantage of this design of the rotor is that liquid which contains bubbles or powder, and which comes out of the central chamber, comes into an annular chamber with a narrow opening and small volume for mixing the bubbles or powder into the liquid. What would have been satisfactory in a liquid with low specific weight, for example water, does not work satisfactory in liquid metal, for example aluminium.

SUMMARY OF THE INVENTION

The main purpose of the invention is to create such a device in connection with a rotor used for addition of a fluid, where the efficiency of the intermixture is further improved. It is particularly desirable to increase the efficiency when adding gas or gas mixtures containing particles, where big size of the bubbles reduces the efficiency.

The invention is described in claim 1. The one or more radial openings are arranged in the lower part of the inner annular wall of the rotational body, in an area which extends down under the surrounding further annular wall.

By the fact that the added fluid passes the annular wall in this way, the intermixture becomes more effective.

Particularly this is valid for gas, where more openings mean smaller bubble diameter.

The rotor of the device according to the invention will, when gas bubbles are supplied, provide that the gas bubbles emerging from the inner row of holes will be sucked into the one or more other annular rooms, so that the gas is treated several times. A corresponding increase of the intermixture will be achieved when supplying other fluids.

BRIEF DESCRIPTION OF THE DRAWINGS

The invention will in the following be described more closely by help of example and with reference to the accompanying drawings where:

FIG. 1 shows an axial intersection through one embodiment of the invention with one extra annular wall, while

DESCRIPTION OF THE PREFERRED EMBODIMENTS

Figure 1:
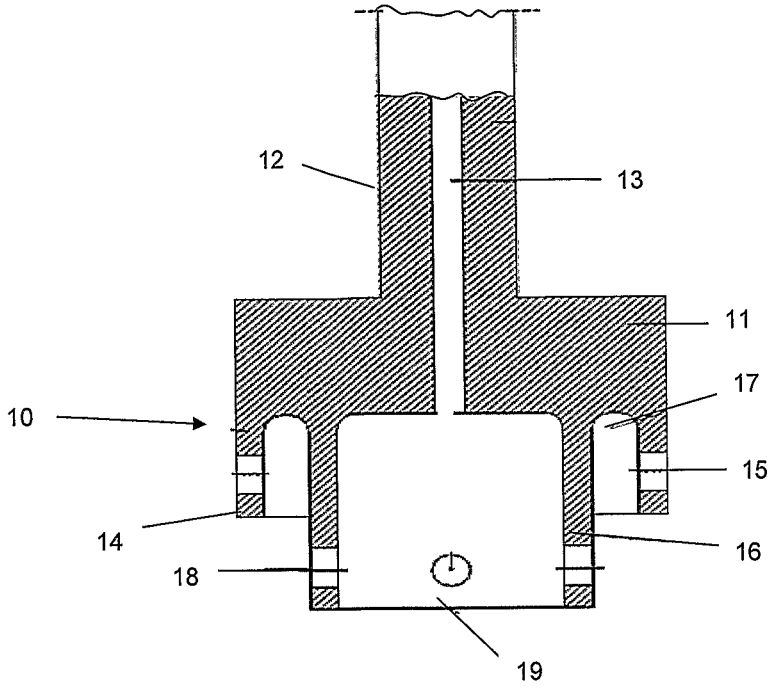

FIG. 1 shows an example of a rotor 10 according to the invention. It comprises a rotational symmetrical main part 11, preferably cylindrical, which is carried by an upwards projecting driven rotor shaft 12 with vertical axis and with a central channel 13.

At the outer edge of the main part 11 there is an outer annular wall 14 which projects downwards with four evenly distributed side holes 15. Between the outer annular wall 14 and an inner concentric annular wall 16 an annular chamber 17 is arranged. The inner concentric annular wall 16 projects downwards below the outer annular wall 14 and has in the projecting area, four evenly distributed side holes 18. Thereby the side holes 18 will end below the mouth of the annular chamber 17. The inner annular wall forms a cylindrical chamber 19 which is supplied with fluid through the central channel 13. The fluid may be a gas and/or particle formed material.

The rotor 10 operates in the following way: It is lowered into a liquid, for example a liquid metal, and is rotated. The liquid will then, due to the rotation of the rotor and thereby the centripetal force which is generated in the fluid, be sucked up in the inner chamber 19 and the annular chamber 17. Gas and/or particles which are supplied through the channel 13 in the rotor shaft 12 will be pressed through the holes 18 out in the surrounding liquid. At the same time, due to the buoyancy and suction, a large part of gas and particles will enter into the annular chamber 17 and emerge through the side holes 15.

Figure 2:
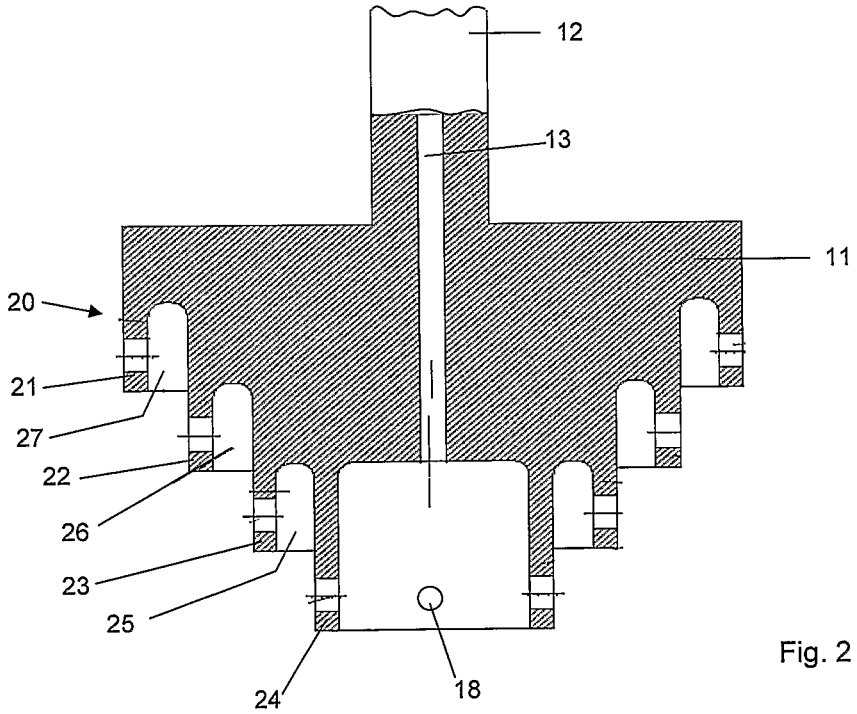
FIG. 2 shows a corresponding axial intersection through a further embodiment of a rotor according to the invention with more extra inner annular walls.

Moreover the invention is not limited to one extra annular wall, but may be provided with two or more additional annular walls. FIG. 2 shows an example of a rotor 20 where it is used one outer annular wall 21 and three stepped downwards projecting additional annular walls 22, 23, 24. Between these annular walls three annular chambers are formed, an inner annular chamber 25, an intermediate chamber 26 and an outer chamber 27.

The annular walls 22-24 have four side holes 18 in the lower part, in a similar way as in the example embodiment in FIG. 1.

The invention claimed is:

1. A device for adding a gas and/or particles to a liquid, including liquid metal, the device comprising:

a rotor which is driven immersed in the liquid, wherein the rotor comprises a hollow rotational body with a first, inner annular wall extending downwards, forming a centrally arranged cylindrical hollow room with an opening directed downwards, wherein the rotor is provided with at least one radially arranged opening extending through the first inner annular wall, and with a second annular wall arranged outside and concentrically arranged with the first annular wall, together forming a downwardly open and upwards closed annular chamber in fluid communication with both the central room through said at least one radial opening and with the surrounding fluid through one or more openings arranged in the lower part of the second annular wall, the first annular wall extending below the lower end of the second annular wall, and the one or more openings of the first annular wall being positioned at a level below the one or more openings in the second, surrounding wall.

2. The device according to claim 1, wherein the hollow rotational body comprises more than two generally concentric annular walls, providing two or more annular rooms outside the central hollow room, and, further, to the annular rooms and to the liquid via at least one opening in each annular wall, as the radial openings are arranged in the lower part of each annular wall.

3. The device according to claim 2, wherein the openings in the annular walls are positioned mutually displaced in the peripheral direction and/or axially related to each other.

4. The device according to claim 1, wherein four openings are arranged in each annular wall.

5. The device according to claim 1, comprising four annular walls.

* * * * *